United States Patent [19]

Musacchia

[11] 4,304,070

[45] Dec. 8, 1981

[54] EMERGENCY AIR VENT STRUCTURE

[75] Inventor: John Musacchia, Marathon, Fla.

[73] Assignees: Charles Citelli, Lexington, N.Y.; John Musacchia, Marathon, Fla. ; a part interest

[21] Appl. No.: 901,447

[22] Filed: May 1, 1978

[51] Int. Cl.[3] ..... E05F 15/20

[52] U.S. Cl. ..... 49/2; 49/13; 49/31; 49/141; 49/379

[58] Field of Search ..... 49/141, 386, 376, 1, 49/2, 4, 7, 379, 31, 13

[56] References Cited

U.S. PATENT DOCUMENTS

| | | | |
|---|---|---|---|
| 509,116 | 11/1893 | Callahan | 49/379 |
| 3,800,687 | 4/1974 | Nozawa | 49/2 X |
| 3,818,635 | 6/1974 | Morita | 49/2 |
| 4,068,417 | 1/1978 | Anghinetti | 49/2 X |
| 4,090,437 | 5/1978 | Bogaert | 49/1 X |

*Primary Examiner*—Kenneth Downey
*Attorney, Agent, or Firm*—John Maier, III

[57] ABSTRACT

An emergency air vent structure actuated by smoke, gas or oxygen deficiency sensors to permit the influx of fresh air to an enclosure. The emergency air vent structure is characterized by a spring-actuated panel which is released by means of a rocker arm and latch actuated by a solenoid which solenoid is operated by any one of a number of detectors such as smoke, gas or oxygen deficiency. Upon opening of the panel, an alarm is sounded giving an audible warning of the unsafe conditions within the building.

6 Claims, 3 Drawing Figures

EMERGENCY AIR VENT STRUCTURE

BACKGROUND OF THE INVENTION

This invention generally relates to an emergency air vent structure which provides automatic venting of buildings where heating unit failures or fire may delete the oxygen content below that needed to sustain life.

The emergency air vent structure ma be actuated by an oxygen deficiency sensor, a gas sensor or smoke sensor and would be installed in conjunction with an alarm.

A critical problem exists particularly in mobile homes and trailers but also in other buildings. Entire families have been killed by means of asphyxiation. Sometimes small fires delete the oxygen content in the building. Faulty heaters have caused the escape of carbon monoxide resulting at least in severe illness and only too often in death.

On occasions, people have been saved by being able to at least crawl as far as a doorway to open it to allow sufficient fresh air in to sustain life until help can arrive. Frequently when people are sleeping, asphyxiation occurs so quickly that the sounding of an alarm is inadequate to help them since they are then frequently dazed from the poisoning. The only solution for them is an immediate introduction of fresh air into the enclosure which is achieved by this invention. Various patents relating to emergency exits are as follows:

| Inventor | Patent Number |
|---|---|
| Burnette | 3,120,032 |
| Gilbert | 3,445,963 |
| Coulter | 3,777,423 |
| Zawadzki | 3,854,763 |
| Kinney | 3,861,739 |
| Coulter | 3,905,063 |
| Lirette | 4,005,886 |

It will be noted in reviewing this art that the solution of a relatively inexpensive and easily installed emergency air vent structure to overcome the problem of asphyxiation was not satisfactorily resolved until the emergence of the instant invention.

SUMMARY OF THE INVENTION

In accordance with the present invention, there is provided an emergency air vent structure actuated by sensing devices to provide an immediate influx of fresh air into an enclosure when a dangerous amount of smoke or poisonous gas develops within the enclosure. The emergency air vent structure is simple to construct, low in cost and provides a long life with dependability.

A spring-actuated panel swings down when a rocker arm is disengaged from a latch by means of a solenoid. Sensing devices are commercially available to provide the necessary electrical signal to the solenoid to release the latch. When the panel opens, a switch is closed causing an alarm to sound upon the opening of the panel.

The novel features which are considered as characteristics of the invention are set forth with particularity in the appending claims. The invention itself, however, as to its construction of obvious advantages, will best be understood from the following description of the specific embodiment when read with the accompanying drawings.

DETAILED DESCRIPTION

Figure 1:
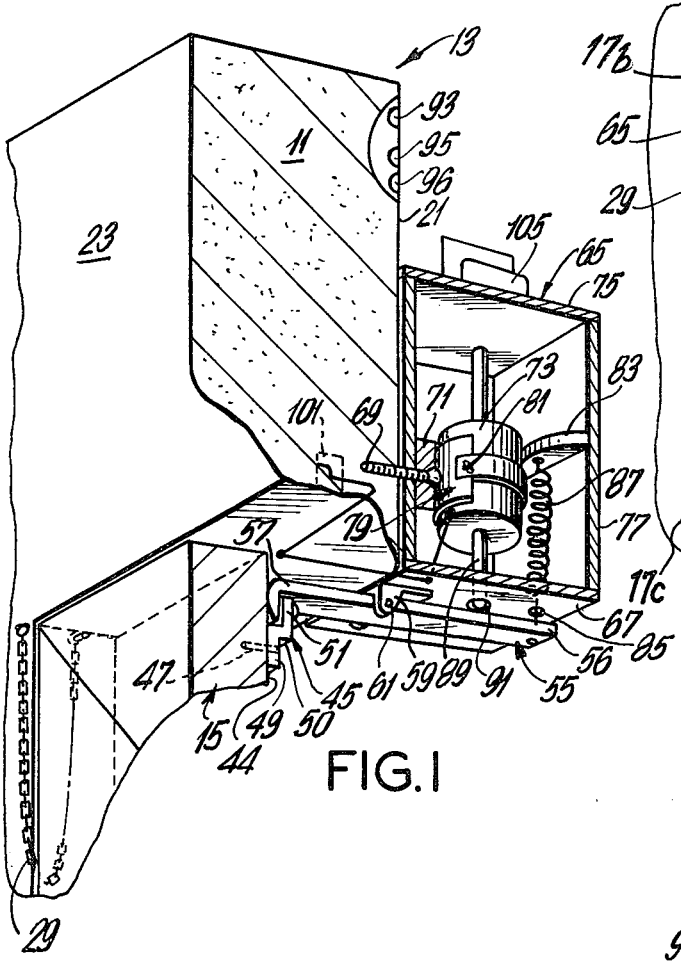
FIG. 1 is a partial perspective view in section showing the invention with the panel closed.

The same reference numerals are used throughout the drawings and specification to note a similar item of the invention.

Referring now to FIG. 1, the outside wall 11 of a building 13 is shown. A panel 15 is mounted within a frame 17 of an opening 19 through the outside wall 11. The frame includes two vertical edges 17*a*, a horizontal upper edge 17*b* and a horizontal lower edge 17*c*. The outside wall 11 has an inside surface 21 and an outside surface 23.

Figure 2:
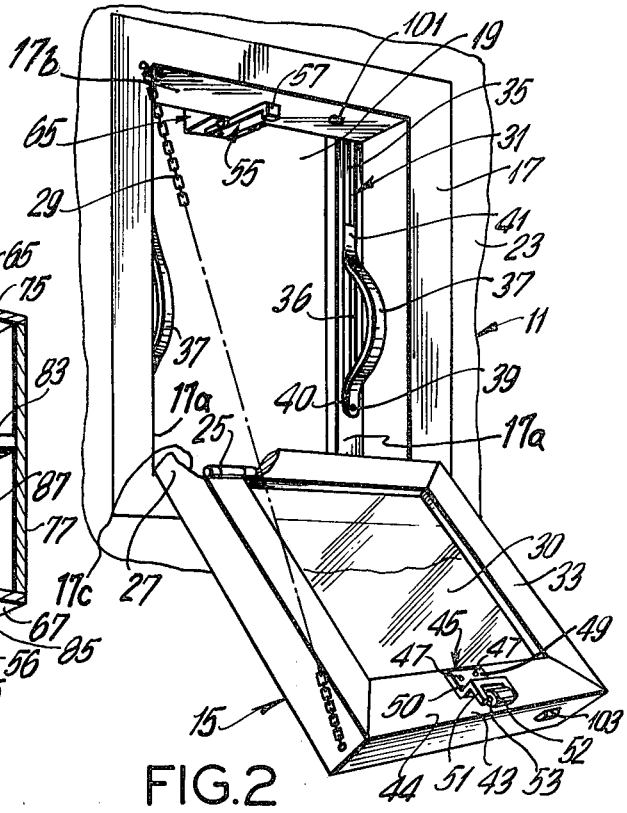
FIG. 2 is a perspective view of the panel being viewed from the outside with the panel in an open position.

Referring to FIG. 2, the panel 15 is mounted on hinges 25 utilized in the usual manner at the base or lower edge 27 of the panel 15 and the lower horizontal edge 17*c* of the frame 17. The panel 15 fits, in a reasonably air tight manner, as is usual with a door or window, within the frame 17. When in the open position, as shown in FIG. 2, a chain 29 prevents the panel 15 from dropping too far down and damaging the hinges 25. A window panel 30 including, if desired, a Miami awning window, may be incorporated into the panel 15.

Two vertical side members 31 are each located on opposite sides of the frame 17 at the edge of the opening 19 and facing the inside 33 of the panel 15. When closed, the panel 15 rests against the two vertical side members 31.

Each vertical side member 31 has an upper deep vertical groove 35 and a lower shallow vertical groove 36. The upper groove 35 and the lower groove 36 are contiguous to one continuous groove. On each vertical side member 31, a flexible band spring 37 is located. The flexible band spring 37 is rigidly secured at its lower end 39 to the respective vertical side member 31 in the lower end 40 of the lower groove 36 and is slidable fitted in the upper groove 35 at its upper end 41.

Immediately upon release of the panel 15, as hereinafter explained, the panel 15 is forced open by means of the flexible band springs 37.

As the panel 15 is closed, as is shown in FIG. 1, its inner surface 33 presses against the pair of flexible band springs 37 forcing the upper end 41 of each flexible band spring 37 to slide upwardly in the upper groove 35 and to recess into the lower groove 36.

As shown in FIGS. 1 and 2, adjacent the upper edge 43 of the inside surface 44 of the panel 15, a latch 45 is located. The latch 45 is secured to the upper edge 43 of the inside surface of the panel 15 by a pair of screws 47. The latch 45 includes a lower section 49 for mounting on the panel 15 and then extends at right angles from the flat mounting section 49 outwardly along an intermediate section 50. An upper section 51 extends back up again parallel to the lower section 49 but spaced from the panel 15 thereby forming a channel. A roller 52, preferably made of nylon, is mounted on a shaft 53, rotatably mounted in the upper section 51.

A rocker bar 55 havig an inside end 56 and an outside end 57 is mounted on a pivot bracket 59 with a pivot pin 61 mounted in it. The rocker bar 55 pivots on the pivot pin 61.

The rocker bar 55 is a flat plate with its outside end 57 adjacent the panel 15 bent at right angles to engage the latch 45 thereby holding the panel 15 in place against the force of the pair of flexible band springs 37.

Mounted on the inside surface 21 of the wall 11, immediately above the panel 15, is a cage or housing 65. The pivot bracket 59 is mounted on the outside of the bottom 67 of the housing 65. The housing 65 is secured to the wall by means of screws 69 which also secure a mounting bracket 71 for a solenoid 73 as is hereinafter explained. The housing 65 includes a top 75 parallel with the bottom 67 and is enclosed with front panel 77. Mounted within the housing 65 is the solenoid 73. A band 79 extends from the mounting bracket 71 around the solenoid 73 and is secured to the mounting bracket 71 by bolts and wing nuts 81. On the inside of the front panel 77 of the housing 65, adjacent to the front panel 77, a bracket 83 is located. In the bottom 67 of the housing 65, a hold 85 is located and a coil spring 87 extends from the bracket 83 to the inside end 56 of the rocker bar 55. In this way, the coil spring 87 holds the inside end 56 of the rocker bar 55 up and thereby retains the bent or outside end 57 of the rocker bar 55 down into the latch 45. The solenoid 73 includes a solenoid shaft 89 which extends downwardly toward the rocker arm 55. A hole 91 located more centrally in the bottom of the housing 65 than the hole 85 permits the solenoid shaft 89 to extend down below the housing 65 and press against the inside end 56 of the rocker bar 55. When the solenoid 73 is actuated, the solenoid shaft 89 moves downwardly moving the inside end 56 of the rocker bar 55 downwardly. This moves the outside end 57 of the rocker bar 55 upwards rotating about the pivot pin 61 on the pivot bracket 59. In this way, the outside end 57 of the rocker bar 55 is pulled out of the latch 45 resulting in the panel 15 opening. When this occurs, as has been previously explained, the force of the band springs 37 forces the panel 15 open causing it to fall downwardly since the panel 15 is hinged at its lower edge 27. The chain 29 prevents excessive falling of the panel 15. Mounted within the building 15 are a smoke detector 93, a gas detector 95 and an oxygen detector 96.

Figure 3:
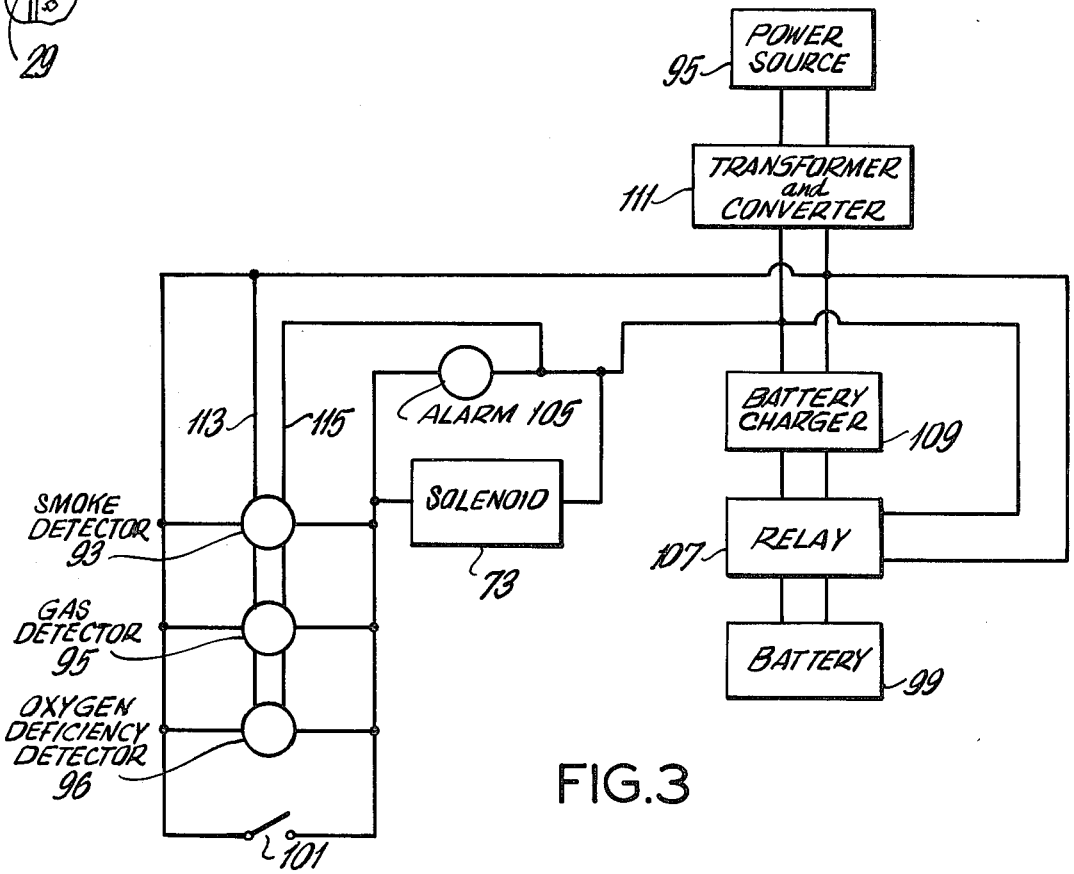
FIG. 3 is an electrical schematic showing the electrical system of the invention.

As best seen also in FIG. 3, upon actuation of the smoke detector 93, the gas detector 95 or the oxygen deficiency detector 96, power either from the normal power source 97 or from a battery 99 in the event of power failure, actuates the solenoid 73. A switch 101 is located in the frame 17 and is held open by the closed panel 15. A switch actuator 103 located on top of the panel 15 presses against the switch 101 when the panel 15 is closed maintaining the switch 101 in an open position. Upon opening of the panel 15, however, the switch 101 closes, sounding an alarm 105. As best seen in FIG. 3, closing of the switches in the sensors or detectors 93, 95, 96 will also actuate the alarm 105, even if the panel 15 should fail to open. A relay 107 both prevents the battery power supply from being utilized while the power is on but also connects a battery charger 109 to the battery thereby keeping it charged when not needed. The power supplied is converted to a low voltage like twelve volts and direct current by a transformer-converter 111, this being the same power supplied by the battery 99. Lines 113, 115 supply power to the detectors 93, 95, 96 to operate them so that any one of them can close the circuit to actuate the solenoid 73 and alarm 105.

Examples of various detectors or sensors may be found in the following United States patent art:

| Inventor | Patent Number |
|---|---|
| Nagao Abe | 3,500,368 |
| Jensen | 3,447,152 |
| R. J. Jordan | 3,445,669 |
| Deuth | 3,430,220 |
| Vasel | 3,382,762 |

The invention may be embodied in other specific forms without departing from the spirit or essential characteristics thereof. The present embodiments are, therefore, to be considered in all respects as illustrative and not restrictive. The scope of the invention being indicated by the appendant claims rather than the foregoing description and all changes which come within the meaning and range of equivalence of the claims are therefore, intended to be embraced therein.

I claim:

1. An emergency air vent structure for use in the outside wall of an enclosure, said structure comprising:

a frame having an upper horizontal edge and a lower horizontal edge and two vertical side edges for mounting in the outside wall of a building;

a panel fitted within said frame generally aligned with the outside wall of the building, said panel engaging said vertical side members when said panel is in a closed position within said frame, said frame including two vertical side members each facing said panel, each vertical side member being located adjacent one of said vertical side edges and having an upper section and a groove in its upper section;

hinge means mounted on (the lower edges of) said panel and frame at the lower horizontal edge of said frame for pivoting said panel outwardly and downwardly from said frame;

a latch secured to said panel;

a rocker bar pivotably mounted adjacent said panel and adapted to engage said latch;

means for retaining said rocker bar in engagement with said latch;

a solenoid for pivoting said rocker bar against the force of said means for retaining said rocker bar in engagement with said latch and for disengaging said rocker bar from said latch;

means including sensor means for actuating the solenoid; and spring means for forcing said panel to pivot about said hinge means, said spring means including a pair of metallic bands having an upper end and a lower end with each metallic band mounted vertically on separate vertical side members, the lower end of each metallic band being secured to its respective vertical side member and the upper end slidably engaging the groove in the upper section of said vertical side member.

2. An emergency air vent structure according to claim 1 wherein:

said latch forms a channel with said panel; and said rocker bar is a flat plate with a small section bent at substantially right angles. said bent section engaging said channel.

3. An emergency air vent structure according to claim 1 further including:

an alarm for sounding a warning;

a switch mounted in said frame and held closed by said panel, said switch being adapted to open when said panel is pivoted about said hinge means by said spring means; and electrical circuit means operatively connected to both said switch and said alarm, said electrical circuit means being partially coextensive with said means for actuating the solenoid.

4. An emergency air vent structure according to claim 1 further including a housing mounted on the inside surface of said outside wall, said solenoid being mounted within said housing.

5. An emergency air vent structure according to claim 4, wherein said means for holding said rocker bar in engagement with said latch includes a coil spring attached to the end of said rocker bar and to said housing.

6. An emergency air vent structure according to claim 1 wherein said sensor means includes a gas detector, a smoke detector and an oxygen deficiency detector.

* * * * *